US005245755A

United States Patent [19]

Krivec

[11] Patent Number: 5,245,755

[45] Date of Patent: Sep. 21, 1993

[54] FORCE-MULTIPLYING MECHANISM

[75] Inventor: Bert Krivec, Waukesha, Wis.

[73] Assignee: Snap-on Tools Corporation, Kenosha, Wis.

[21] Appl. No.: 939,443

[22] Filed: Sep. 2, 1992

[51] Int. Cl.[5] ..... B26B 29/06; B26B 29/00; B26B 13/22; B26B 13/00

[52] U.S. Cl. ..... 30/189; 30/190; 30/242; 30/251

[58] Field of Search ..... 30/184, 189, 190, 242, 30/251

[56] References Cited

U.S. PATENT DOCUMENTS

| | | | |
|---|---|---|---|
| Re. 20,613 | 5/1981 | Nakamura | 30/190 |
| 838,008 | 12/1906 | Chandler | 30/242 |
| 985,048 | 2/1911 | Meissner . | |
| 1,046,771 | 12/1912 | Goodnow | 30/190 |
| 1,354,755 | 10/1920 | Hultman . | |
| 1,368,244 | 2/1921 | Disrochers | 30/190 |
| 1,428,600 | 9/1922 | McCullough | 30/190 |
| 2,280,159 | 4/1942 | Neal | 30/251 |
| 2,436,260 | 2/1948 | Klenk . | |
| 2,463,213 | 3/1949 | Stewart | 30/190 |
| 2,469,036 | 5/1949 | Hart . | |
| 2,505,502 | 4/1950 | Moberg . | |
| 3,273,240 | 9/1966 | Florian . | |
| 3,333,607 | 8/1967 | Haraden | 30/251 |
| 4,178,682 | 12/1979 | Sadauska | 30/251 |
| 4,221,048 | 9/1980 | Parramore | 30/189 |
| 4,825,735 | 5/1989 | Undin . | |

*Primary Examiner*—Frank T. Yost
*Assistant Examiner*—Paul M. Heyrana
*Attorney, Agent, or Firm*—Emrich & Dithmar

[57] ABSTRACT

A force-multiplying device includes a base or stationary structure and three levers all pivotally mounted on the base and each having a force input end and a force output end and being arranged in a folded configuration such that each lever extends from the force input and to the force output end thereof in a direction generally opposite to that of adjacent levers in the series. The pivot point of each lever is closer to its force output end than to its force input end so that the force delivered at the output end is greater than that applied at the input end. The base and the output lever may operate as a pair of opposed jaws, each carrying a removable force application device for different applications such as cutting, crimping, punching, lifting and spreading. The input lever and the base structure may be configured as handles of a hand-operated tool and the levers may be arranged to either open or close the jaws in response to movement of the handles together.

20 Claims, 4 Drawing Sheets

FORCE-MULTIPLYING MECHANISM

BACKGROUND OF THE INVENTION

1. Field of the Invention

The present invention relates to force-applying tools or mechanisms and, in particular, to mechanisms for providing a mechanical advantage such that the force delivered to a workpiece is a large multiple of the force input by a user.

2. Description of the Prior Art

Various types of pivoting lever-type tools are available, such as pliers, cutters, crimpers, spreaders and the like, which essentially operate on the basis of a lever action, the lever being arranged so that the tool can deliver an output force which is greater than the input force applied by a user. In general, the leverage or mechanical advantage is a function of the handle length, so that as the force requirement increases the handle length must be extended to generate the required output force. This effectively limits the amount of output force which can be practicably produced.

It is known to provide a ratcheting-type action in pivoting-jaw tools, such as cutters and the like, whereby repeated opening and closing of the handles is required to effect a movement of the jaws through a predetermined angle. But this does not significantly increase the force which can be applied with any one handle manipulation.

In general, the average ratio of input to output force in a pivoting handle tool is the inverse of the distance of the handle stroke. Various types of compound linkages have been provided in hand tools, some of which provide very high force multiplication at or near the end of the handle stroke. For example, Vise-Grip pliers can provide, at clamping, a theoretically infinite ratio of input to output force. But such prior tools, while they may produce a relatively high average ratio of input to output force, do not produce very high ratios until near the end of the handle stroke. It is desirable in certain applications, such as the cutting of thick cables, steel pins or the like, to be able to produce an output force on the workpiece of several thousand pounds and, in particular to achieve a very high ratio of input to output force throughout the handle stroke. Heretofore, there has not been provided any tool which can produce this substantially constant high ratio of input to output force even at the beginning of the handle stroke.

SUMMARY OF THE INVENTION

It is a general object of the invention to provide an improved force-multiplying apparatus which avoids the disadvantages of prior apparatuses while affording additional structural and operating advantages.

An important feature of the invention is the provision of a force-multiplying mechanism which affords a substantially constant force multiplication throughout the stroke of the force input member.

In connection with the foregoing feature, another feature of the invention is the provision of a force-multiplying mechanism which affords at least a 50-fold force multiplication throughout substantially the entire stroke of the force input member.

In connection with the foregoing features, yet another feature of the invention is the provision of a mechanism of the type set forth which is manually operable.

Still another feature of the invention is the provision of a mechanism of the type set forth which is of compact construction.

Yet another feature of the invention is the provision of a mechanism of the type set forth which is of simple and economical construction.

Still another feature of the invention is the provision of a mechanism of the type set forth which provides removable and replaceable force application devices for use in different types of applications.

These and other features of the invention are attained by providing a force-multiplying mechanism comprising: a base, a series of levers pivotally mounted on the base and each having a force input portion and a force output portion, the levers including an input lever and an output lever and at least one intermediate lever, each of the levers except the output lever having its output portion coupled to the input portion of the immediately following lever in the series, and a force application device carried by the output portion of the output lever.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 2:
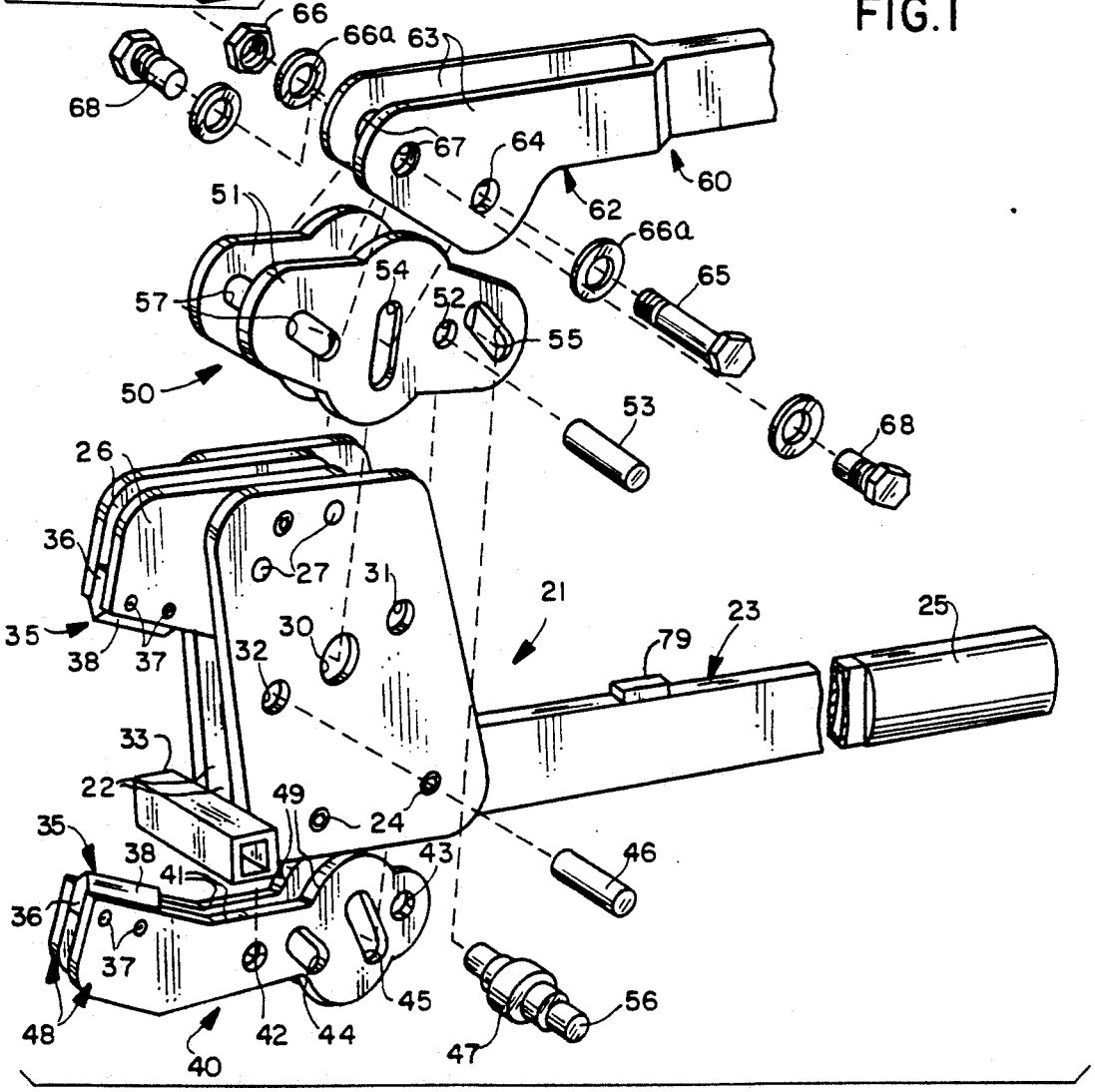
FIG. 2 is a fragmentary exploded, perspective view of the mechanism of FIG. 1.
Figure 3:
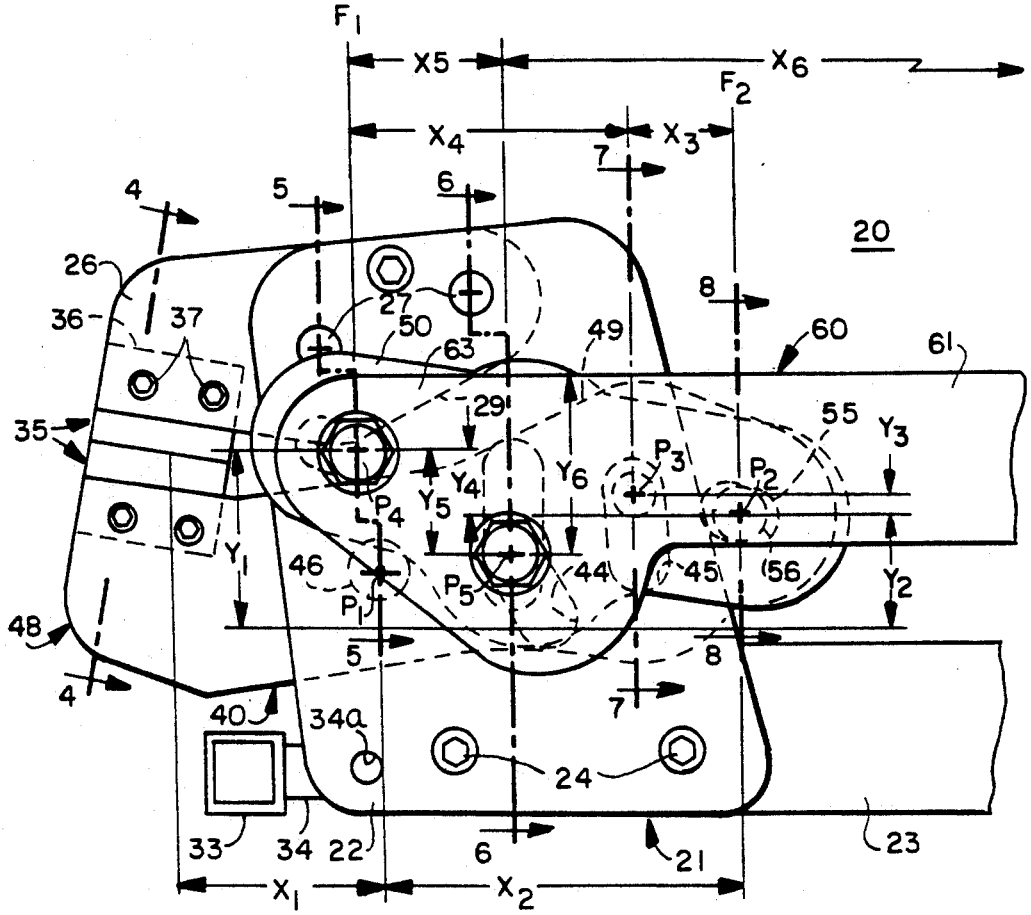
FIG. 3 is an enlarged, fragmentary, side elevational view of the mechanism of FIG. 1.
Figure 5:
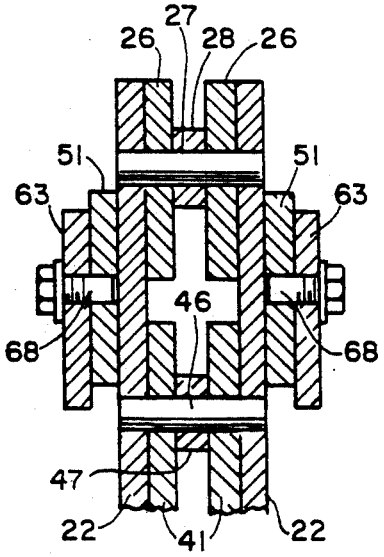
FIG. 5 is a fragmentary sectional view taken along the line 5—5 in FIG. 3.
Figure 6:
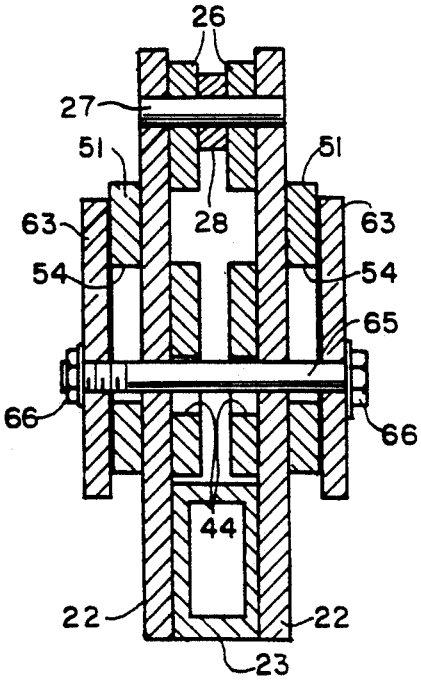
FIG. 6 is a sectional view taken along the line 6—6 in FIG. 3.
Figure 7:
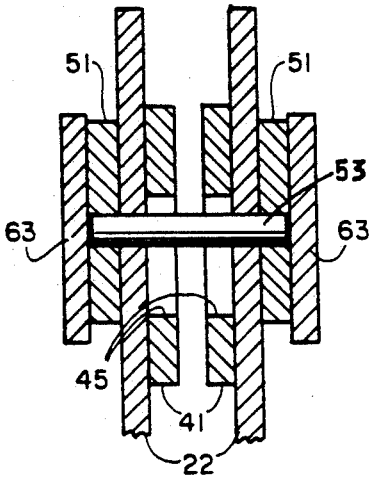
FIG. 7 is a fragmentary sectional view taken along the line 7—7 in FIG. 3.

Referring to FIGS. 1-13, there is illustrated a cutter tool 20 incorporating a force-multiplying mechanism in accordance with the present invention. The cutter tool 20 is designed for hand operation and has a handle structure 21 (FIG. 13) which includes a pair of congruent base plates 22 and a handle member 23 disposed between the base plates 22 at the lower end thereof, fixedly secured thereto by pins 24, and extending rearwardly therefrom to a handle or force input portion 25 adjacent to the distal end thereof. If desired, the portion of the handle member 23 disposed between the base plates 22 may have an enlarged thickness and may be of hollow tubular construction, substantially rectangular in transverse cross section, as illustrated in FIG. 6. The handle structure 21 also includes a pair of jaw plates 26 disposed between the base plates 22 at the upper end thereof and fixedly secured thereto, as by pins 27. Cylindrical spacers 28 (FIGS. 5 and 6) may be disposed between the jaw plates 26 coaxially with the pins 27. The jaw plates 26 project forwardly a predetermined distance beyond the forward end of the base plates 22. The rear ends of the jaw plates 26 define bearing surfaces 29 (FIGS. 3 and 13) on their undersides disposed generally in facing relationship with the handle member 23, for a purpose to be explained more fully below. Formed respectively through the base plates 22 generally centrally thereof are two coaxial circular pivot holes 30 (one shown). Also respectively formed through the base plates 22 rearwardly and forwardly of the pivot holes 30 are coaxial pivot holes 31 and coaxial pivot holes 32. A stabilizer tube 33 extends laterally of the base plates 22 just forwardly thereof at the bottom thereof, the tube 33 being mounted in place by a mounting block 34 which extends rearwardly between the base plates 22 and is fixedly secured thereto by a fastener 34*a* (FIG. 3). Preferably, the tube 33 is rectangular in transverse cross section and is adapted to slidably receive therethrough an elongated rectangular bar (not shown) for providing lateral stability to the cutter tool 20 in certain applications, as will be explained more fully below.

The portions of the jaw plates 26 projecting forwardly from the base plates 22 carry a cutter 35, which includes an attachment flange 36 disposed between the jaw plates 26 and fixedly secured thereto, as by screws 37, and an elongated blade 38 which projects downwardly from the jaw plates 26 and is substantially V-shaped in transverse cross section (see FIGS. 1-4).

Figure 8:
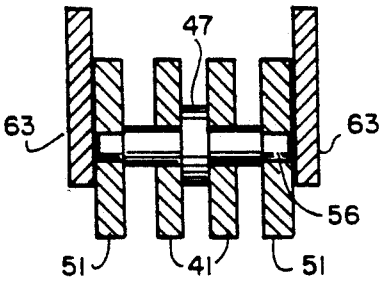
FIG. 8 is a sectional view taken along the line 8—8 in FIG. 3.

The cutter tool 20 also has an elongated output lever 40 (FIG. 10) which includes a pair of congruent plates 41 (FIGS. 1, 2 and 4-9) disposed between the base plates 22. Formed respectively through the lever plates 41 are a first pair of coaxial pivot holes 42 disposed slightly forwardly of the longitudinal midpoint of the lever 40, a second pair of coaxial pivot holes 43 disposed adjacent to the rearward end of the lever 40, and two pairs of elongated slots 44 and 45 disposed between the pivot holes 42 and 43. A pivot pin 46 (FIGS. 2, 3 and 5) is received coaxially through the pivot holes 32 in the base plates 22 and the pivot holes 42 in the output lever plates 41 for pivotally mounting the output lever 40 on the handle structure 21. Spacers 47 may be disposed between the lever plates 41 coaxially with the pivot holes 42 and 43 (FIGS. 2, 5 and 8). The length of the output lever 40 is such that, when thus pivotally mounted, the pivot holes 43 are disposed rearwardly of the base plates 22 and the lever plates 41 project forwardly of the base plates 22 a predetermined distance to define force output or jaw portions 48. Formed on the upper edges of the lever plates 41 between the pivot holes 42 and 43 are bearing surfaces 49, disposed for engagement with the bearing surfaces 29 on the jaw plates 26. Disposed between the jaw portions 48 is another cutter 35, fixedly secured by screws 37 and having the blade 38 thereof disposed in opposed facing relationship with that of the cutter 35 on the jaw plates 26.

Figure 1:
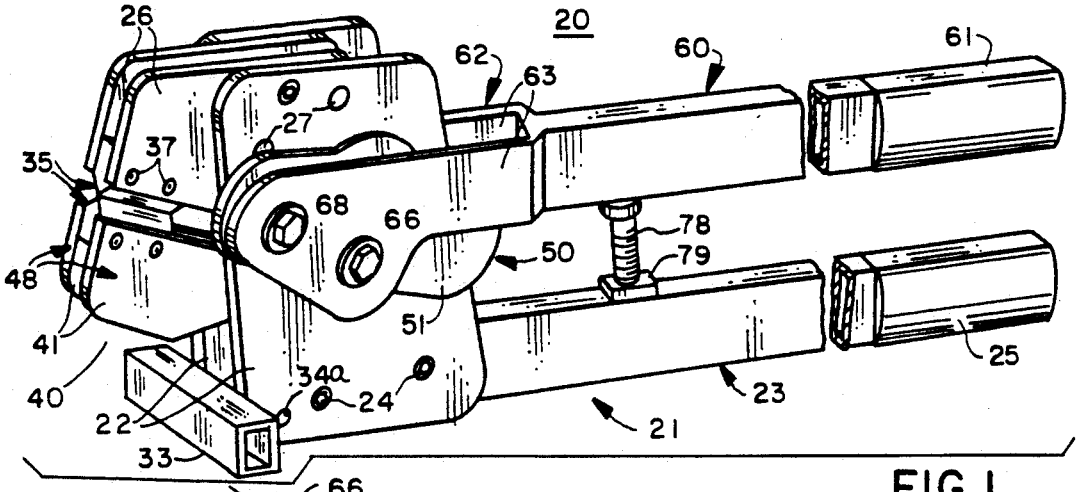
FIG. 1 is a perspective view of a force-applying mechanism in accordance with the present invention, with portions broken away and with the device illustrated in a closed condition.
Figure 4:
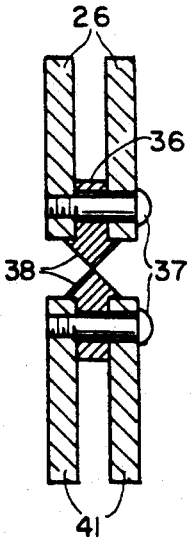
FIG. 4 is a sectional view taken along the line 4—4 in FIG. 3.

In operation, the output lever 40 is pivotally movable between a closed position, illustrated in FIGS. 1, 3 and 4, wherein the edges of the cutter blades 38 are disposed in opposed cutting engagement with each other, and a fully open condition (not shown) wherein the bearing surfaces 49 abut the bearing surfaces 29. The output lever 40 is illustrated in an intermediate position in FIG. 9.

The cutter tool 20 also has an intermediate lever 50 (FIG. 11), which includes a pair of congruent elongated plates 51, respectively having coaxial pivot holes 52 formed therethrough rearwardly of the longitudinal midpoint thereof. The lever plates 51 are respectively disposed along the outer sides of the base plates 22 parallel thereto, with the pivot holes 52 respectively coaxially aligned with the pivot holes 31 in the base plates 22 for coaxially receiving therethrough a pivot pin 53, pivotally to mount the intermediate lever 50 on the handle structure 21. Formed respectively through the lever plates 51 are a pair of congruent elongated slots 54 generally centrally of the length of the lever 50, a pair of congruent elongated pivot slots 55 adjacent to the rearward end of the lever 50 and a pair of elongated congruent slots 57 adjacent to the forward end of the lever 50. The rearward or force output end of the intermediate lever 50 is pivotally connected to the rearward or force input end of the output lever 40 by an elongated pivot pin 56 which extends through the slots 55 of the lever plates 51 and the pivot holes 43 of the lever plates 41, the pin 56 extending coaxially through the spacer 47 between the lever plates 41.

The cutter tool 20 also has an input lever or handle member 60 (FIG. 12), which includes a force input handle portion 61 at one end thereof and is provided at the other end thereof with a clevis 62 (FIG. 2), which includes a pair of parallel plates 63 respectively provided with coaxial pivot holes 64 therethrough intermediate their ends. The clevis 62 is dimensioned so as to straddle, in use, the intermediate lever 50 parallel thereto, being pivotally mounted on the handle structure 21 by an elongated pivot pin, which may be in the nature of a carriage bolt 65 and extends through the pivot holes 64, the slots 54 in the intermediate lever 50, the pivot holes 30 in the base plates 22 and the pivot slots 44 in the output lever 40 for engagement with a nut 66 (FIGS. 2 and 6). Washers 66*a* may be provided between the clevis plates 63 and, respectively, the nut 66 and the head of the bolt 65. The clevis plates 63 are also provided at their forward ends, respectively, with threaded coaxial pivot holes 67, which are respectively aligned with the pivot slots 57 in the intermediate lever plates 51, respectively threadedly receiving therethrough pivot pins 68 for pivotally coupling the force output end of the input, lever 60 to the force input end of the intermediate ever 50 (FIGS. 2, 3 and 5).

Figure 9:
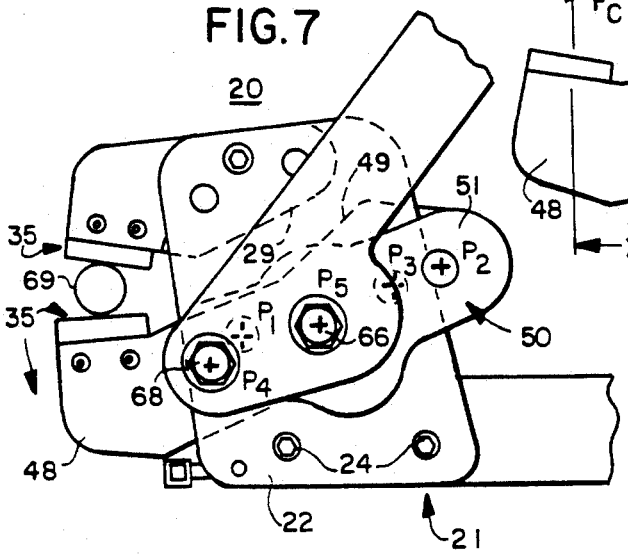
FIG. 9 is a reduced, fragmentary, side elevational view of the mechanism of FIG. 3, illustrated in an open condition.

It can be seen that the cutter tool 20 includes a series of levers interconnected end to end. More specifically, the input lever 60 comprises a first lever fulcrumed at the pivot pin 65 and having a force input end adjacent to the distal end of the handle portion 61 for application of force by the hand of the user, as designated by the arrow $F_H$ in FIG. 12, and a force output end at the pivot pins 68 for delivering an output force $F_1$. This output force is delivered to the force input end of the intermediate lever 50, which is the second lever in the series, fulcrumed at the pivot pin 53. The intermediate lever 50 has a force output end at the coupling pin 56 which delivers an output force $F_2$ (FIG. 11) to the force input end of the output lever 40, which constitutes the third lever in the series, fulcrumed at the pivot pin 46. The output lever 40 has a force output end at the associated cutter 35, which cooperates with the opposed cutter on the jaw plates 26 to deliver an application or cutting force $F_C$ (FIG. 10) to an associated workpiece 69 (FIG. 9). It will be appreciated that the elongation of the slots 44 and 45 in the output lever 40 and the slots 54, 55 and 57 in the intermediate lever 50 accommodates the relative pivotal movements of the several levers while they remain pivotally interconnected with one another.

Figure 10:
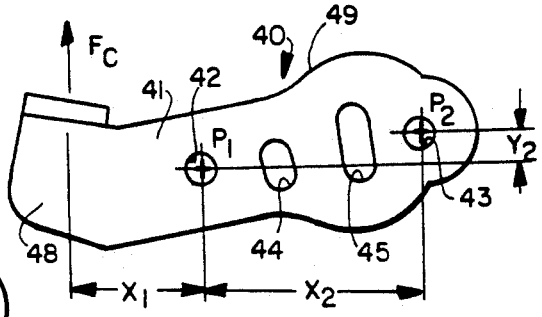
FIG. 10 is a side elevational view of the output lever member of the mechanism of FIG. 2.
Figure 11:
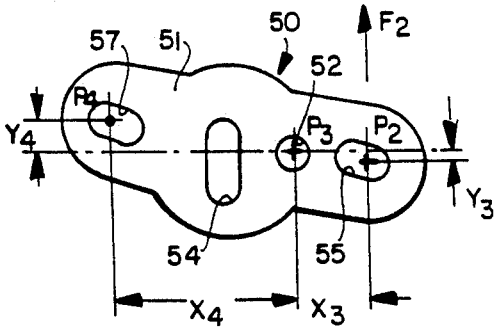
FIG. 11 is a side elevational view of the intermediate lever member of the mechanism of FIG. 2.
Figure 12:
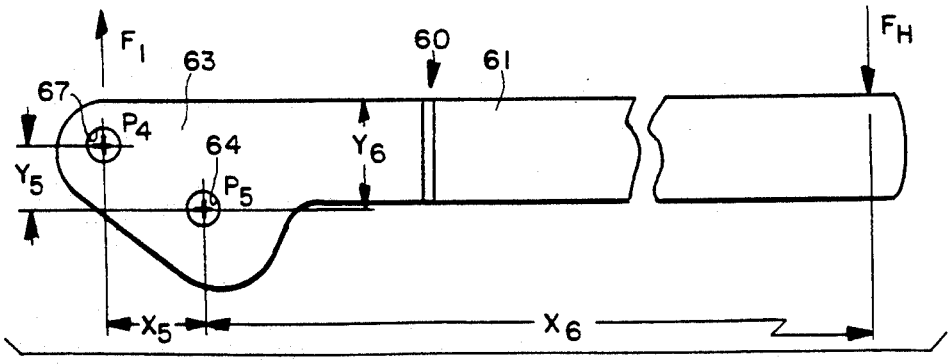
FIG. 12 is a side elevational view of the input lever handle of the mechanism of FIG. 2.
Figure 13:
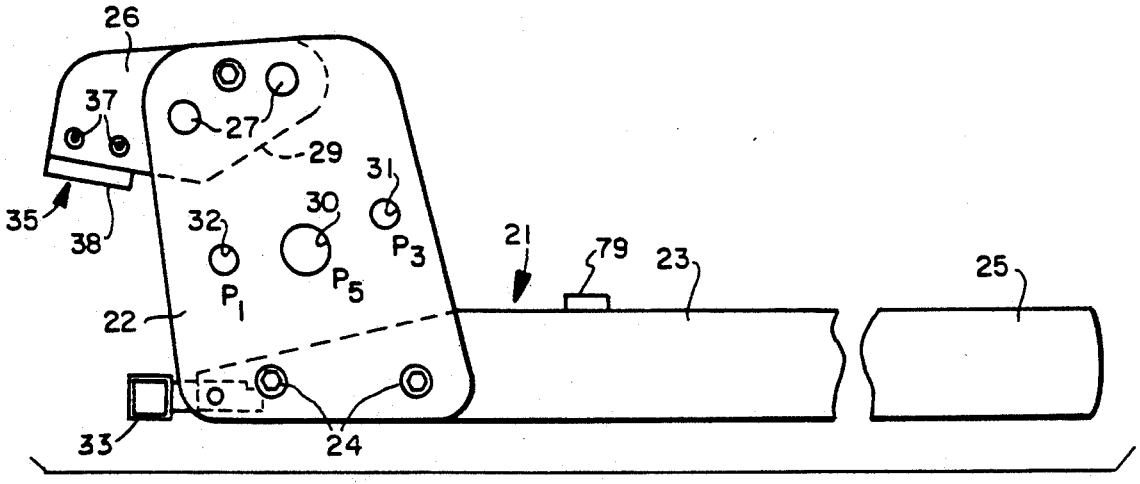
FIG. 13 is a fragmentary side elevational view of the base handle member of the mechanism of FIG. 2.

A fundamental aspect of the invention is that the series of levers is arranged so as to afford a substantial force multiplication. Accordingly, each lever in the series is arranged so that its output force is substantially greater than its input force. Thus, the force output end of the output lever 40 is spaced from its fulcrum a distance $X_1$ which is substantially less than the distance $X_2$ between the fulcrum and the force input end of the output lever 40 (FIG. 10). Similarly, the force output end of the intermediate lever 50 is spaced from its fulcrum by a distance $X_3$, which is substantially less than the distance $X_4$ between the fulcrum and the force input end of the intermediate lever 50 (FIG. 11). In like manner, the force output end of the input lever 60 is spaced a distance $X_5$ from its fulcrum, which is substantially less than the distance $X_6$ between the fulcrum and the input end of the lever 60 (FIG. 12).

It is another significant aspect of the invention that the cutter tool 20 is of compact construction, this compactness resulting from the fact that the several levers in the series are arranged in a folded configuration. Thus, as can best be seen in FIGS. 1-3, each of the levers is arranged such that it extends from its force input portion to its force output portion in a direction generally opposite that of adjacent levers in the series. More specifically, the input lever 60 extends from its force input end to its force output end in a direction generally forwardly of the cutter tool 20, while the intermediate lever 50 extends from its force input end to its force output end generally rearwardly, and the output lever 40 extends from its force input end to its force output end generally forwardly. This minimizes the overall length of the cutter tool 20.

The actual length of the cutter tool 20 will be dependent upon the magnitude of the application force $F_C$ which is required to be delivered by the tool, since the force multiplication or mechanical advantage achieved by each lever in the series is determined by the ratio of its input moment arm to its output moment arm. Thus, $F_1 = (F_H X6)/X_5$, while $F_2 = (F_1 X_4)/X_3$ and $F_C = (F_2 X_2)/X_1$. In a constructional model of the invention, the moment arms were designed such that $X_1 = 2.80$ in., $X_2 = 3.90$ in., $X_3 = 1.24$ in., $X_4 = 3.20$ in., $X_5 = 1.7$ in. and $X_6 = 24$ in. Also it is significant that each lever in the series pivots through a smaller angle than the immediately preceding one. In that model the application of an input force $F_H$ of 150 lbs. resulted in a delivery of an application force $F_C$ in excess of 7,600 lbs., which is an overall force multiplication of about 51 times. Because the cutter tool 20 is designed to be portable and to be a hand-operated pivoting handle device, the actual length of any one of the levers is, as a practical matter, limited to a size which can be conveniently carried and manipulated by a user. Within these constraints, however, it will be appreciated that a wide range of force multiplications can be achieved.

It is a significant aspect of the invention that the unique arrangement of the levers of the cutter tool 20 provides a substantially uniform force multiplication throughout the stroke of the input lever 60. Thus, the full force multiplication is available almost immediately when the input lever 60 begins its movement from an open to a closed condition. This is significant in cutting relatively thick items, such as steel rods or cables.

For purposes of illustration, the cutter tool 20 has been disclosed with each of the handle structure 21, the output lever 40, the intermediate lever 50 and the input lever 60 comprising parallel, spaced-apart, plate-like members. This has the advantage of permitting all of the various force applications by each of the series of levers to be in the same plane, centered between the two plates. However, this is not essential to the operation of the mechanism and, if desired, each of the handle structure 21, the output lever 40, the intermediate lever 50 and the input lever 60 could be of a single-plate construction. Also, it will be appreciated that the parts of the cutter tool 20 could be formed of any suitable materials which have the requisite strength. However, the cutter blades 38 will preferably be formed of a hardened metal or metal alloy suitable for cutting the associated workpiece, which may be a steel bar, cable, rivet, bolt or the like. In this regard, it is significant that the cutters 35 are readily replaceable in the jaw plates 26 and the jaw portions 48. Thus, different types of cutters could be used for different applications.

Figure 14:
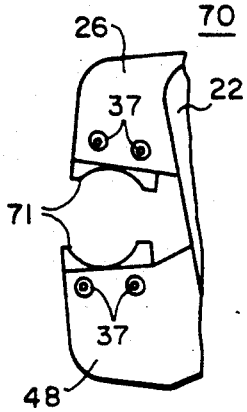
FIG. 14 is a fragmentary, side elevational view, similar to FIG. 9, illustrating an alternative application of the mechanism of the present invention.
Figure 15:
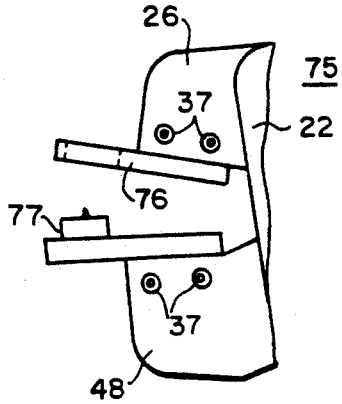
FIG. 15 is a view similar to FIG. 14 illustrating still another application of the present invention.

Referring also to FIGS. 14 and 15, the cutters 35 could be replaced with other types of application devices. Thus, in FIG. 14 there is illustrated a crimper tool 70, which is substantially identical to the cutter tool 20, except that the cutters 35 are replaced with crimper bits 71 for crimping an associated workpiece. While the crimper bits 71 are configured for crimping a cylindrical workpiece, it will be appreciated that any desired shape could be utilized. In FIG. 15 there is illustrated a punching tool 75, which is identical to the cutter tool 20, except that the cutters are replaced, respectively, with a die member 76 and a punch member 77 for use in a punching application.

Preferably, the input lever 60 is provided with an adjusting screw 78 on the input lever 60 adapted for engagement with a bearing plate 79 on the handle member 23 to limit the closing movement of the input lever 60 and provide a minimum spacing between the input lever 60 and the handle member 23. This will serve to protect the hands of a user and also protect the cutters 35 or other application devices.

Figure 16:
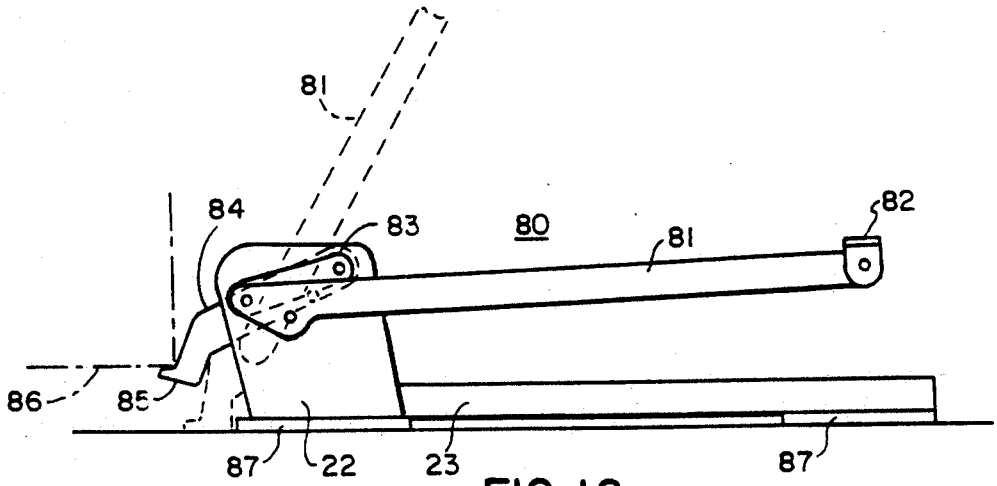
FIG. 16 is a side elevational view of a modified version of the present invention for still another application.

While hand-operated tools are disclosed in FIGS. 1-15, it is a significant aspect of the invention that its principles can be applied more widely to other force-multiplication applications. Referring to FIG. 16, there is illustrated a lifting tool 80 which is designed for foot operation. The lifting tool 80 is substantially similar to the cutter tool 20, having a base which is substantially the same as the handle structure 21, including base plates 22 and an elongated handle member 23, but instead of being adapted for hand operation, they may both be provided at their distal ends with feet or pedestals 87 adapted to be supported on the ground or other underlying support surface. In this application, the jaw plates 26 of the cutter tool 20 are dispensed with. The lifting tool 80 includes an elongated lever arm 81 which is analogous to the input lever 60 of the cutter tool 20 and is provided at its input or distal end with a step pedal 82. The lever arm 81 is pivotally mounted on the base plates 22 in the same manner as was the input lever 60 described above, and is pivotally coupled to an intermediate lever 83, which is analogous to the intermediate lever 50 and may be similarly mounted. The intermediate lever 83 is, in turn, coupled to an output lever 84, which is analogous to the output lever 40 and is similarly pivoted on the base plates 22. The output lever 84 is provided at its distal end with a lifting lug 85 adapted to be fitted beneath an associated load or workpiece 86 to be lifted. In operation, when the load 86 is seated on the lifting lug 85, it will hold the lever arm 81 in a raised position, illustrated in broken line in FIG. 16. The user then steps on the pedal 82, lowering the lever arm 81 and raising the lifting lug 85 and the associated load 86. It will be appreciated that in this application the stabilizer bar will be used in the tube 33 to prevent tilting of the tool 80 during foot operation.

It will also be appreciated that, by suitable modification of the shape of the output lever 84 and by the addition of a fixed output jaw at the lower end of the base plates 22, the lifting tool 80 could be modified to function as a spreading tool, the two jaws moving away from each other when the lever arm 81 is lowered to spread an associated workpiece. Other related applications are also possible.

From the foregoing, it can be seen that there has been provided an improved force-multiplying mechanism, which is portable and may be hand-operable, is of simple, compact and economical construction, is capable of force multiplications of at least 50 times, and which is adaptable for a variety of applications.

I claim:

1. A non-ratcheting force-multiplying mechanism comprising: a base, a series of levers each pivotally mounted on said base and each having a force input portion and a force output portion, said levers including an input lever and an output lever and at least one intermediate lever, each of said levers except said output lever having its force output portion coupled to the force input portion of the immediately following lever in the series, and a force application device carried by the force output portion of said output lever.

2. The mechanism of claim 1, wherein the number of said levers is three.

3. The mechanism of claim 1, and further comprising a second force application device carried by said base, said force application devices being disposed for cooperation with each other to apply force to an associated workpiece.

4. The mechanism of claim 3, wherein said force application devices are removably mounted on said base and said output lever.

5. The mechanism of claim 3, wherein said force application devices are cutting blades.

6. The mechanism of claim 3, wherein said force application devices are crimping jaws.

7. The mechanism of claim 3, wherein said force application devices are, respectively, punch and die members.

8. The mechanism of claim wherein each of said levers has a fulcrum disposed at the pivotal mount thereof between the force input and force output portions thereof and closer to said force output portion than to said force input portion.

9. The mechanism of claim 8, wherein said levers are arranged in a folded configuration such that each lever extends from its force input portion to its force output portion in a direction generally opposite that of adjacent levers in the series.

10. The mechanism of claim 9, wherein said levers are arranged to provide a substantially constant force multiplication throughout the entire range of movement of said input lever.

11. The mechanism of claim 1, wherein said base includes a pair of spaced-apart members, said output lever being disposed between said members.

12. A non-ratcheting force-multiplying hand-operated tool comprising: first and second handle structures interconnected for relative pivotal movement about a pivot axis, each of said handle structures having a handle end and a working end respectively disposed on opposite sides of the pivot axis, a first force application device carried by said first handle structure at the working end thereof, a series of levers including an output lever each pivotally mounted on said first handle structure and each having a force input portion and a force output portion, each of said levers except said output lever having its force output portion coupled to the force input portion of the immediately following lever in the series, the first lever in the series having its force input portion coupled to the working end of said second handle structure, and a second force application device carried by said force output portion of said output lever for cooperation with said first force application device for applying force to an associated workpiece.

13. The tool of claim 12, wherein said working ends of said handle structures respectively define jaws movable between open and closed conditions relative to each other.

14. The tool of claim 13, wherein said levers are dimensioned and arranged so that movement of the handle ends of said handle structures toward each other effects movement of said jaws toward each other.

15. The tool of claim 13, wherein said levers are so dimensioned and arranged that movement of the handle ends of said handle structures toward each other effects movement of said jaws away from each other.

16. The tool of claim 13, wherein said force application devices are cutting blades.

17. The tool of claim 13, wherein said levers are arranged to provide a substantially constant force multiplication throughout the entire range of movement of said input lever.

18. The tool of claim 12, wherein said force application devices are removably mounted on said first handle structure and said output lever.

19. The tool of claim 12, wherein said series of levers includes two levers.

20. The tool of claim 12, wherein said levers are arranged in a folded configuration such that each extends from the force input portion to the force output portion thereof in a direction generally opposite to that of adjacent levers in the series, each of said levers having the pivot point thereof disposed between the force input and force output portions thereof and closer to the latter than to the former.

* * * * *

UNITED STATES PATENT AND TRADEMARK OFFICE

CERTIFICATE OF CORRECTION

PATENT NO. : 5,245,755

DATED : September 21, 1993

INVENTOR(S) : Bert Krivec

It is certified that error appears in the above-indentified patent and that said Letters Patent is hereby corrected as shown below:

On title page, item [56] References Cited
At the end, --Snap-on Tools Corporation 1992 catalog pages 177 and 178-- should be inserted.

Column 8, line 4, insert --1-- after "claim".

Signed and Sealed this

Thirty-first Day of January, 1995

Bruce Lehman

*Attest:*

BRUCE LEHMAN

*Attesting Officer*

*Commissioner of Patents and Trademarks*